United States Patent [19]

Chyla et al.

[11] Patent Number: 4,965,419

[45] Date of Patent: Oct. 23, 1990

[54] METAL-CLAD, COMPRESSED GAS-BLAST CIRCUIT-BREAKER

[75] Inventors: Thomas Chyla; Manfred Meinherz, both of Berlin, Fed. Rep. of Germany

[73] Assignee: Simens Aktiengesellschaft, Berlin & Munich, Fed. Rep. of Germany

[21] Appl. No.: 467,058

[22] Filed: Jan. 18, 1990

[30] Foreign Application Priority Data

Feb. 2, 1989 [DE] Fed. Rep. of Germany ..... 3904148

[51] Int. Cl.[5] ..... H01H 33/42

[52] U.S. Cl. ..... 200/147 R; 200/148 F; 200/148 B

[58] Field of Search ..... 200/148 R, 148 F, 148 A, 200/148 B

[56] References Cited

FOREIGN PATENT DOCUMENTS 0075668 4/1983 European Pat. Off. .
2847221 10/1979 Fed. Rep. of Germany .
2943386 4/1980 Fed. Rep. of Germany .
7601366 2/1981 Fed. Rep. of Germany .
2089571 6/1982 United Kingdom .

*Primary Examiner*—Robert S. Macon
*Attorney, Agent, or Firm*—Kenyon & Kenyon

[57] ABSTRACT

A metal-clad, compressed gas-blast circuit-breaker having a gas-filled housing and an interrupter unit supported in the housing by a hollow post insulator. The circuit-breaker has a shifting linkage with at least one insulating drive rod, the shifting linkage transmitting the switching motion from a driving mechanism to a movable switching contact. In order to reduce the overall axial length of the circuit-breaker, the hollow post insulator comprising only insulating material, is penetrated only by the insulating drive rod and has, for fixing to the housing, on an end area facing away from the interrupter unit, on an outside surface, a premolded flanged ring mounted set back axially from the edge and being adapted to the bearing ring of the housing. The described circuit-breaker is esepcially suited for application in gas-insulated, metal-clad, high-voltage switching stations.

4 Claims, 5 Drawing Sheets

METAL-CLAD, COMPRESSED GAS-BLAST CIRCUIT-BREAKER

BACKGROUND OF THE INVENTION

The present invention relates to a metal-clad, compressed gas-blast circuit-breaker having a gas-filled housing and an interrupter unit, which is supported in the housing by a hollow post insulator and whose movable switching contact is connected to a shifting linkage penetrating the post insulator. The shifting linkage comprises at least one insulating drive rod, whereby the post insulator at its one end area bears the interrupter unit and is secured at its other end area to an outer support of the housing.

Such a metal-clad, compressed gas-blast circuit-breaker is known from GB No. 2,089,571A. In the case of this known circuit-breaker, the shifting linkage consists of a combination of insulating and metallic drive rods between the interrupter unit and the location where a driving movement supplied by an external drive unit is introduced into the housing of the circuit-breaker. Thereby, during the breaking movement or rather in the switch-off position, the lower end of the metallic drive rod projects into the interior of the hollow post insulator, which is thereby dielectrically stressed. In addition, in the case of the post insulator, the metallic mounting reinforcements are fused in the walls and thus form a part of the post insulator.

SUMMARY OF THE INVENTION

An object of the present invention is to considerably reduce the axial length of the shifting linkage.

The above and other objects of the invention are achieved by a metal-clad, compressed gas-blast circuit-breaker having a gas-filled housing and an interrupter unit, the interrupter unit being supported in the housing by a hollow post insulator having a movable switching contact connected to a shifting linkage penetrating the post insulator and comprising at least one insulating drive rod, the post insulator having one end area bearing the interrupter unit and being secured at another end area to an outer support of the housing, the post insulator being penetrated only by the insulating drive rod and further comprising only insulating material, the post insulator having an end area facing away from the interrupter unit, and bearing on the outside a premolded flanged ring mounted set back axially from the edge and being adapted to a bearing ring serving as an outer support mounted on the housing.

According to the invention by no longer using the metal rods which had previously been inserted in the shifting linkage, one attains a considerable reduction in the overall axial length. Also, the dielectric load of the post insulator is thereby as low as possible, so that cast integral or fused metal reinforcements are avoided and an insulating and nonmetallic drive rod projects into the interior of the post insulator. Furthermore, a particularly large section of the axial length of the post insulator is available as insulating clearance, because the flanged ring is mounted on the outside. In this manner, the bearing ring of the housing also does not come into direct contact with the hot switching gases.

On the opposite end, that is on the end turned toward the interrupter unit, a cut-in edge area and a clamping plate can be provided on the post insulator while leaving an opening dimensioned for the passage of the rod and switching gases. When this clamping plate is placed on the inner edge area of the post insulator, it has wall sections extending into the opening of the post insulator to delimit a specific area for the passage of the rod and a specific area for the discharge of switching gases out of the interrupter unit. In this manner, damaging effects that the switching gases subject the insulating drive rod to are kept to a minimum in the area of the passage into the inside space of the post insulator as well.

The shifting linkage can be formed by two parallel, insulating drive rods, which are flexibly connected, e.g., with articulation to the switching contact and to a blast or compression cylinder used to generate a gas flow, as well as on their opposite ends, to a fork lever, which can be actuated for closing and breaking operations via a shaft, which is sealingly introduced into the housing of the interrupter unit. In this configuration, the drive rods carry out a movement which is similar to that of connecting rods. In this connection, the post insulator can have a hollow truncated-cone shape whose orifice size, in the area where it is fastened to the bearing ring on the side of the housing, is enlarged compared to the end area secured to the interrupter unit. This enlargement corresponds to the angular travel of the drive bars during closing and breaking operations. Moreover, the truncated- cone-like shape of the post insulator proves to be beneficial for strength and ease of fabrication in the casting or injection molding process.

One can further reduce the damaging effects that the switching gases emerging from the interrupter unit subject the insulating drive rods and the post insulator to by mounting a controlling element between the interrupter unit and the post insulator This controlling element takes up and guides the flow of the switching gases during the switch-off or breaking operation. It allows only a portion of the switching gases to pass through in the direction of the linkage and diverts the remaining portion in an at least radial direction, whereby the controlling element surrounds the adjacent end area of the post insulator with a rounded-off torus. In this manner, besides the removal of the load through switching gases, the dielectric loading of the post insulator in the area where it is connected to the controlling element is still reduced.

BRIEF DESCRIPTION OF THE DRAWINGS

The invention will be described in greater detail in the following detailed description with reference to the drawings, in which.

DETAILED DESCRIPTION

Figure 1:
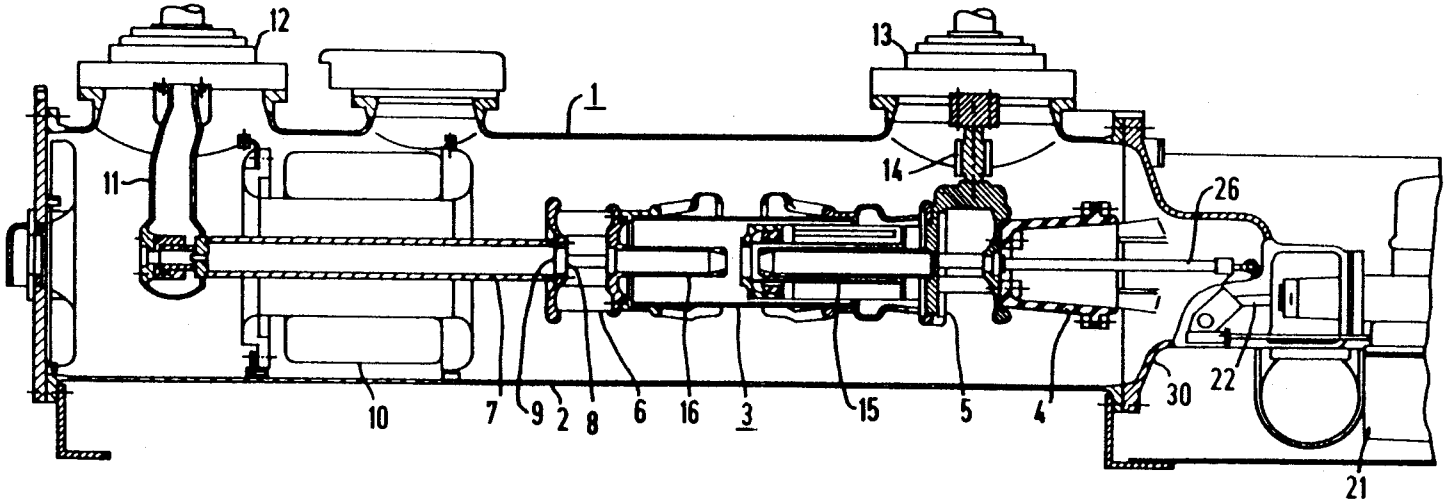
FIG. 1 shows a metal-clad, compressed gas-blast circuit-breaker for a high voltage switching station in a greatly reduced schematic representation, in longitudinal section, to clarify the fundamental components of the circuit-breaker.

The metal-clad, compressed gas-blast circuit-breaker 1 depicted in FIG. 1 is especially provided for application in metal-clad and compressed-gas insulated, high-voltage switching stations. An interrupter unit designated as a whole with 3 is mounted in a housing 2 consisting of sheet metal, for example. The longitudinal axis of the interrupter unit coincides approximately with the longitudinal axis of the housing 2. To attach the interrupter unit 3, on its driving end, a hollow, somewhat truncated-cone shaped post insulator 4 is provided which is connected to a controlling element 5 and, on the opposite end, a further controlling element 6 is provided which is connected to a tubular conductor 7. This tubular conductor 7 serves at the same time as a primary winding for a current transformer 10. On its part, the tubular conductor 7 is supported by a retention arm 11 which is used at the same time to conduct current and by bushing 12 opposite the housing 2. A further bushing 13 is connected via a coupling contact arrangement 14 to the controlling element 5, whose design and functions shall be clarified at a later stage.

The interrupter unit 3 belongs to the puffer circuit-breaker type and has two contact conduits 15 and 16, which mutually oppose each other and are axially in alignment, as well as a stationary puffer 17 and a movable puffer cylinder 18. See FIG. 3. In the depicted switch-off position, the puffer 17 and a movable puffer cylinder 18. In the depicted switch-off position, the puffer 17, the puffer cylinder 18 and a switching contact 20, which can slide between the puffer 17 and contact 15, are situated in the area of the contact conduit 15. For the switching-on operation, the switching contact 20 and the puffer cylinder 18 are shifted to the left over the contact conduit 16 in a generally known way so that the contact conduits 15 and 16 are jumpered by the switching contact 20. The actuating movements for switching on and off are released by an actuator unit 21, which is arranged outside of the housing 2 more or less in its axial projection and which operates a shaft 24 by means of a connecting rod 22 and a crank 23. In a generally known way, this shaft 24 passes in a gas-tight manner through the inner wall of the housing 2 and bears a fork lever 25 there. Flexibly connected to the ends of the fork lever 25 are two drive rods 26. These drive rods are mounted parallel to each other and extend through the post insulator 4 and the controlling element 5 and, in a way which will be described later on, are connected to the puffer cylinder 18 and the switching contact 20.

Figure 2:
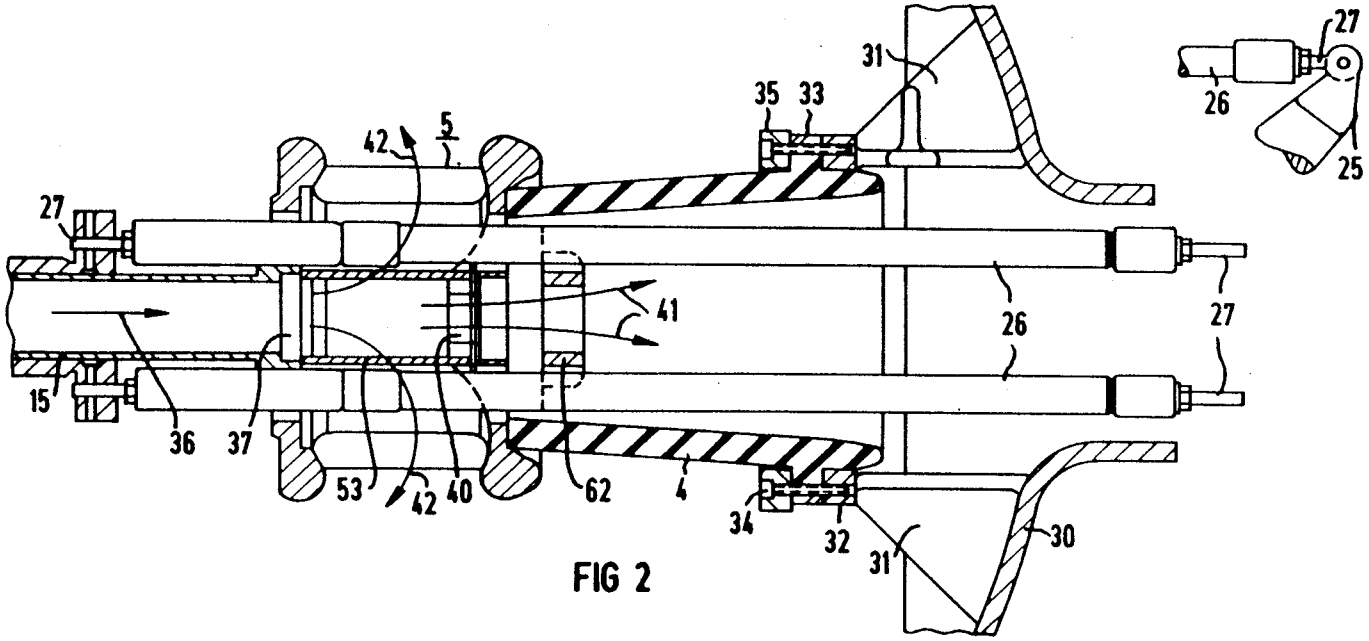
FIG. 2 shows, in an enlarged representation compared to FIG. 1, in sectional view, that area of the circuit-breaker, in which the branching off of the switching gases into an axial and a radial flow takes place.
Figure 3:
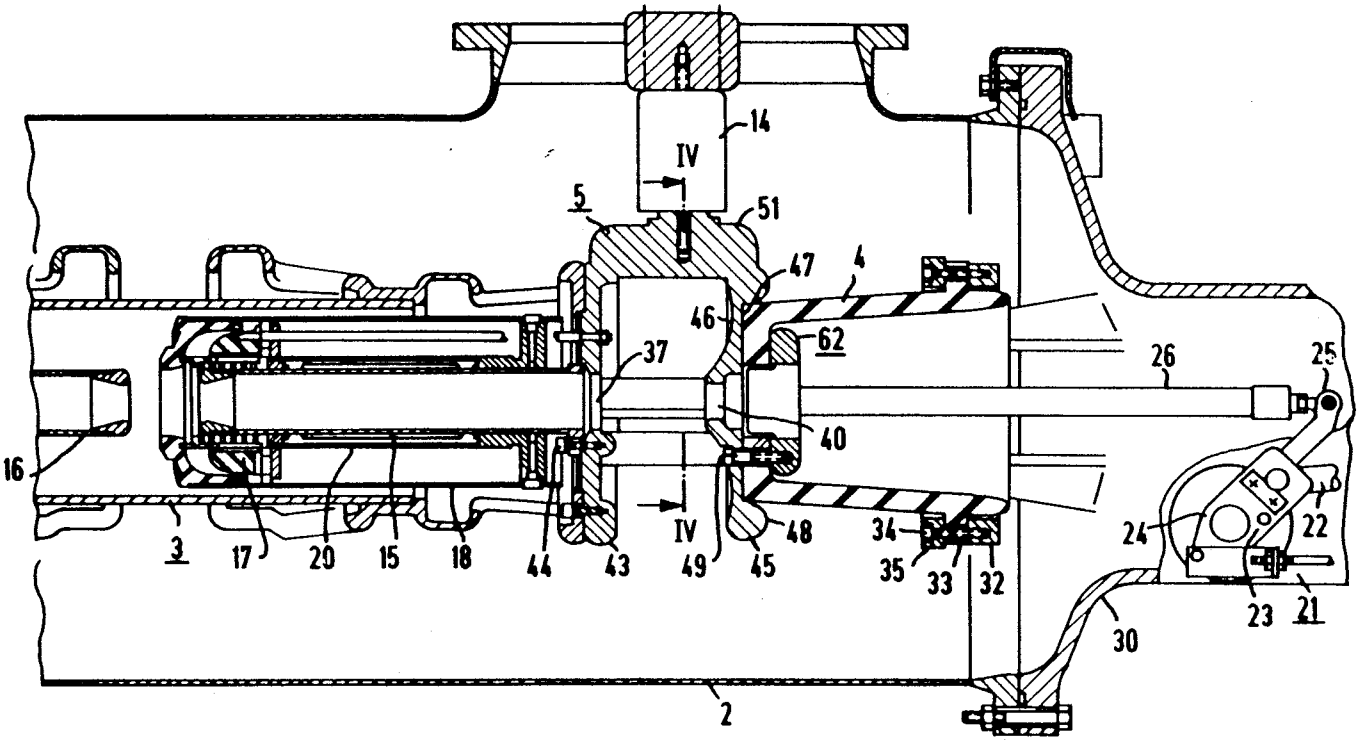
FIG. 3 shows, in a longitudinal section rotated by 90° compared to FIG. 2, the controlling element, the post insulator and adjacent areas of the circuit-breaker.

In FIG. 2, a cut-away portion of the circuit-breaker 1 according to FIGS. 1 and 3 is shown in the area of the post insulator 4 and the drive rods 26. This representation is rotated by 90° compared to the aforementioned figures, so that both parallel-mounted drive rods 26 are visible. Furthermore, one can recognize that the drive rods 26 are visible. Furthermore, one can recognize that the drive rods 26 are provided on both ends with eye pieces 27 to provide for an articulated connection with the switching contact 20 or with the fork lever 25. One can also recognize that a bearing ring 32 is internally supported via ribs 31 on a head piece 30 of the housing 2. In the casting process, the bearing ring 32 and ribs 31 can be manufactured in one piece with the head piece 30. The post insulator 4 rests with a premolded flanged ring 33 on the bearing ring 32. The premolded flanged ring 33 is shown separately again in FIG. 5. Screws 34 brace the post insulator 4 opposite the bearing ring 32 by way of a clamping ring 35 placed on the flanged ring 33.

Figure 4:
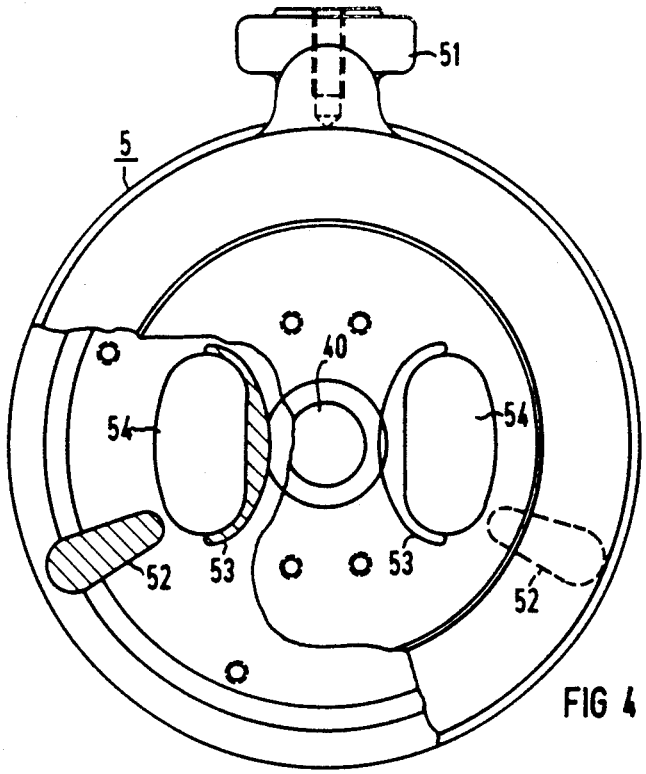
FIG. 4 shows the controlling element partially opened up in an axial section along line IV—IV of FIG. 3, to show the wall sections which shield the drive rods.

While the design of the controlling element 5 shall still be explained separately based on FIGS. 3 and 4, FIG. 2 is especially useful to illustrate the mode of operation of the controlling element when the circuit-breaker 1 is switched off For this purpose, the flow of the switching gases inside the contact conduit 15 is indicated with an arrow 36. Since an intake port 37 of the controlling element 5 corresponding to the cross-section of the contact conduit 15 is opposed on the controlling element's opposite side only by a smaller exhaust port 40, only one portion of the switching gases designated with the arrows 41 retains the original direction of flow and thus, continuing more or less in the direction of the drive rod 26, attains the housing 2 through the post insulator 4. Another portion of the switching gases which is designated with the arrows 42 exits the controlling element 5 at its periphery. As indicated by the shape of the arrows 42, the switching gases are diverted in a direction which is more than radial, to avoid striking the wall of the housing 2 directly and, instead, to achieve a thorough mixing of cool and heated gases through the circulation of these gases in the housing 2. Particulars concerning the controlling element 5 shall now be explained in greater detail based on FIG. 3.

The controlling element 5 possesses a wall section 43 in which is situated the intake port 37. This wall section is connected by screws 44 to the interrupter unit 3. An additional wall section 45, in which is found the exhaust port 40, is positioned parallel to the wall section 43. The wall section 45 is provided on the inside with a ring-shaped depression 46 which is convex to such an extent that the switching gases are diverted in more than the radial direction as indicated in FIG. 2 by the arrows 42. On its periphery, the wall section 45 is provided with a central depression 47, in which the post insulator 4 engages with its end area 50.

The wall sections 43 and 45 are connected, bridge-like, only over a small part of their periphery. At the same time, this segment forms an electrical connection for the interrupter unit 3 by way of the coupling contact arrangement 14 mentioned already in the description of FIG. 1.

In addition to the segment 51 both wall sections 43 and 45 of the controlling element 5 are reinforced by supporting ribs 52 and shielding ribs 53. In this case, the shielding ribs 53 limit the oval openings 54 provided on both sides of the intake port 36 and the exhaust port 40 for the passage of the drive rods 26. In this manner, the drive rods are prevented from being directly pressurized by the hot switching gases. Thus, the controlling element 5 is open at the largest part of its periphery.

Figure 6:
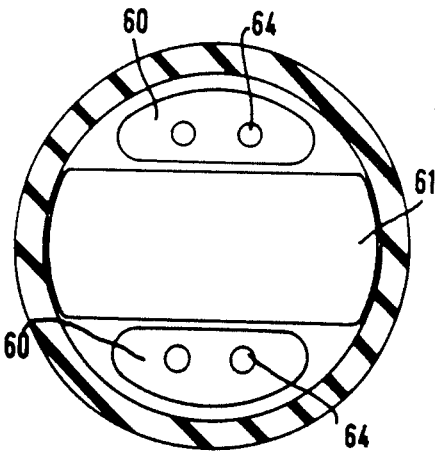
FIG. 6 shows an end area of the post insulator according to FIG. 5 turned toward the controlling element along a section VI—VI in FIG. 5 and FIGS. 7, 8 and 9 show, in views of sections rotated by 90°, a clamping plate which connects the post insulator to the controlling element.
Figure 5:
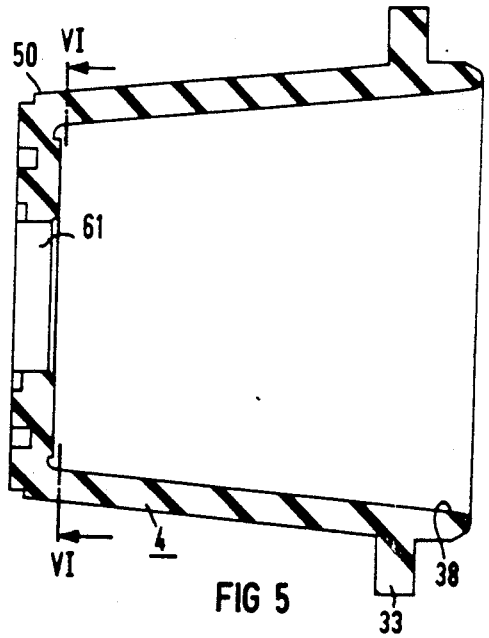
FIG. 5 shows a post insulator in an axial section.

The post insulator 4 depicted separately in FIGS. 5 and 6 has more or less the shape of a hollow truncated cone and, in its end area 50, has two mutually opposing cut-in areas 60 provided for the passage of fastening screws. An opening 61 for the switching gases and the drive rods 26 remains between the edge areas. Furthermore, the post insulator 4 possesses at its end facing opposite the end area 50 the already mentioned flanged ring 33, which is arranged set back axially with respect to the end of the post insulator. As FIG. 3 shows in particular, with this design, the post insulator projects through the bearing ring 32 on the side of the housing, so that the mounting configuration consisting of the bearing ring 32, the flanged ring 33, the clamping ring 35 and the fastening screws 34 is situated completely outside of the gas flow (arrows 41 in FIG. 2) running through the post insulator 4. For the further dielectric unloading of the post insulator 4, the central depression 47 of the wall section 45 of the controlling element 5 is encircled by a rounded torus 48 (FIG. 3), which is premolded on the wall section 45.

Figure 7:
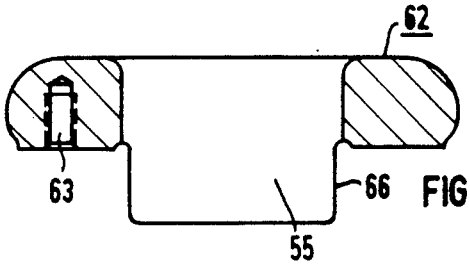
Figure 8:
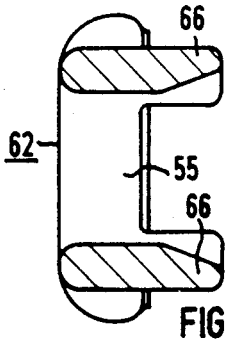
Figure 9:
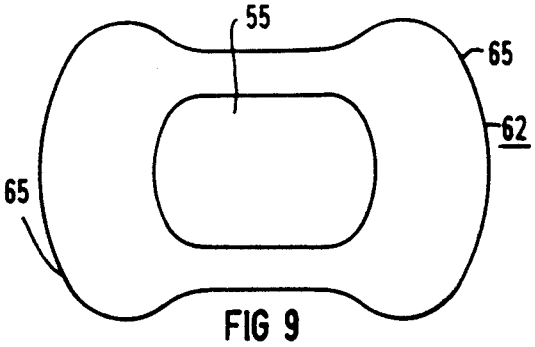

A clamping plate 62 shown in two sections and in a view in FIGS. 7, 8 and 9 is used to secure the post insulator 4 to the wall section 45 of the controlling element 5. The clamping plate 62, with its elongated, rounded off and laterally drawn-in shape (FIG. 9), has mutually opposing shanks 65 intended for seating on the edge areas 60 of the post insulator 4. In these shanks 65 are found blind holes 63 for screws 49, which extend through the wall section 45 of the controlling element 5 (FIG. 3) and through the through-holes 64 in the edge areas 60 of the post insulator 4 (FIG. 6). Wall sections 66 (FIGS. 7 and 8), whose form is particularly clear from FIG. 7, extend between the shanks 65. The clamping plate 62 extends with these wall sections into the opening 61 in the end area 50 of the post insulator 4 (FIG. 6), to delimit a section of the entire cross-section of the opening 61 provided for the passage of the switching gases from lateral areas used for the passage of the drive rods 26 (FIGS. 2 and 3). At this location, as well, the drive rods are thus shielded from the flow of the hot switching gases.

As already mentioned, a further controlling element 6 is situated on the outgoing end of the interrupter unit 3. This controlling element 6 likewise serves to distribute the flow of switching gases emerging from the contact conduit 16 into an axial and a radial portion. The somewhat parallel arrangement of two wall sections and supporting ribs situated between them corresponds essentially to the design of the controlling element 5 described on the basis of FIGS. 3 and 4. Accordingly, situated opposite an intake port of the controlling element 6 is a smaller exhaust port 8 (FIG. 1) in a wall section, which is provided with a ring-shaped depression to divert a portion of the switching gases in a radial, or more pronounced than radial, direction. This exhaust port 8 is situated at the entrance of a buffer chamber 9, which is formed by the interior space of the tubular conductor 7. This interior space can either be closed or provided on its end with relief ports. During a switching operation, as a result of the compression of a portion of the switching gases, the buffer chamber 9 acts as a temporary storage. After the completion of the switching operation, the switching gases flow away again and take part in the general intermixing of heated and cool gases in the housing 2.

In this manner, the amount of stress that all parts are subjected to is reduced during the switching operation.

As one can infer from the above description, particularly in connection with FIGS. 1 and 3, the described circuit-breaker is distinguished by a comparatively short type of construction, which is achieved by eliminating the metallic drive rods previously used between the actuator unit and the interrupter unit. In this manner, the interrupter unit 3 can be retained in the housing 2 at the drive end by a relatively short post insulator 4. Thereby, the stress that the post insulator and the insulating drive rods are subjected to as a result of the switching gases is reduced by the controlling element 5 mounted between the post insulator 4 and the interrupter unit 3, so that one can select a post insulator with a relatively simple design and a short overall axial length.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A metal-clad, compressed gas-blast circuit-breaker having a gas-filled housing and an interrupter unit, supported in the housing by a hollow post insulator and having a movable switching contact connected to a shifting linkage penetrating the post insulator and comprising at least one insulating drive rod, the post insulator having one end area bearing the interrupter unit and being secured at another end area to an outer support of the housing, the post insulator penetrated only by the insulating drive rod and comprising only of insulating material and having on the end area facing away from the interrupter unit, on an outside surface, a premolded flanged ring, mounted set back axially from the edge and being adapted to a bearing ring serving as an outer support mounted on the housing.

2. The circuit-breaker recited in claim 1, further comprising a cut-in edge area and a clamping plate provided on the post insulator for fixing to the interrupter unit while allowing an opening dimensioned for the passage of the minimum of one drive rod and switching gases, whereby when said clamping plate is placed on the edge area of the post insulator, the clamping plate has wall sections extending into the opening of the post insulator to delimit a specific area for the passage of the minimum of one drive rod and a specific central opening for the discharge of switching gases out of the interrupter unit.

3. The circuit-breaker recited in claim 1, wherein a controlling element is mounted between the interrupter unit and the post insulator and said controlling element takes up and guides the flow of the switching gases during the switch-off operation and allows only a portion of the switching gases to pass through in the direction of the minimum of one drive rod and diverts the remaining portion in an at least radial direction, and said controlling element surrounds the adjacent end area of the post insulator with a rounded-off torus.

4. The circuit-breaker recited in claim 1, wherein the post insulator has the shape of a hollow, truncated cone, whose orifice size, in the area where it is fastened to the bearing ring on the side of the housing, is enlarged compared to the end area secured to the interrupter unit, whereby the enlargement corresponds to the angular travel of the drive rods during closing and breaking operations.

* * * * *